US010648772B2

(12) United States Patent
Williams et al.

(10) Patent No.: US 10,648,772 B2
(45) Date of Patent: May 12, 2020

(54) FIREARM SIGHT ADJUSTMENT TOOL

(71) Applicant: Otis Products, Inc., Lyons Falls, NY (US)

(72) Inventors: Nicholas Otis Williams, Naples, FL (US); Nathan Denzle Williams, Naples, FL (US); Jeremy Michael Finley, Cape Coral, FL (US)

( * ) Notice: Subject to any disclaimer, the term of this patent is extended or adjusted under 35 U.S.C. 154(b) by 0 days.

(21) Appl. No.: 16/193,268

(22) Filed: Nov. 16, 2018

(65) Prior Publication Data

US 2019/0145736 A1 May 16, 2019

Related U.S. Application Data

(60) Provisional application No. 62/587,173, filed on Nov. 16, 2017.

(51) Int. Cl.
*F41G 1/54* (2006.01)

(52) U.S. Cl.
CPC ..... *F41G 1/545* (2013.01)

(58) Field of Classification Search
CPC ..... F41G 1/54; F41G 1/545
USPC ..... 42/108
See application file for complete search history.

(56) References Cited

U.S. PATENT DOCUMENTS

| | | | | | |
|---|---|---|---|---|---|
| 3,564,949 | A * | 2/1971 | Hedrick | F41G 1/16 | 81/176.15 |
| 5,966,825 | A * | 10/1999 | Biemont | F41G 1/545 | 42/136 |
| 2011/0197489 | A1* | 8/2011 | Barsoumian | F41G 1/545 | 42/90 |
| 2011/0283588 | A1* | 11/2011 | Samson | F41A 35/00 | 42/108 |
| 2013/0192118 | A1* | 8/2013 | Shipman | F41C 27/00 | 42/108 |
| 2015/0204635 | A1* | 7/2015 | Blish | F41G 1/545 | 7/138 |
| 2017/0043469 | A1* | 2/2017 | Keng | B25F 1/02 | |

* cited by examiner

*Primary Examiner* — Bret Hayes
(74) *Attorney, Agent, or Firm* — The Brickell IP Group, PLLC; A. Robert Weaver

(57) ABSTRACT

A firearm sight adjustment tool is disclosed which is capable of interfacing with a firearm sight adjustment mechanism that includes a compressible pin, a rotatable wheel, and a protrusion projecting away from the wheel. The tool includes a first component having a grip on the top side and a shaft from the bottom side. The tool also has a second component with a tunnel to receive the shaft as well as a pin press protruding from the bottom of the second component. In use, the shaft is rotatable within the tunnel to apply torque to the protrusion while the pin press compresses the pin.

8 Claims, 3 Drawing Sheets

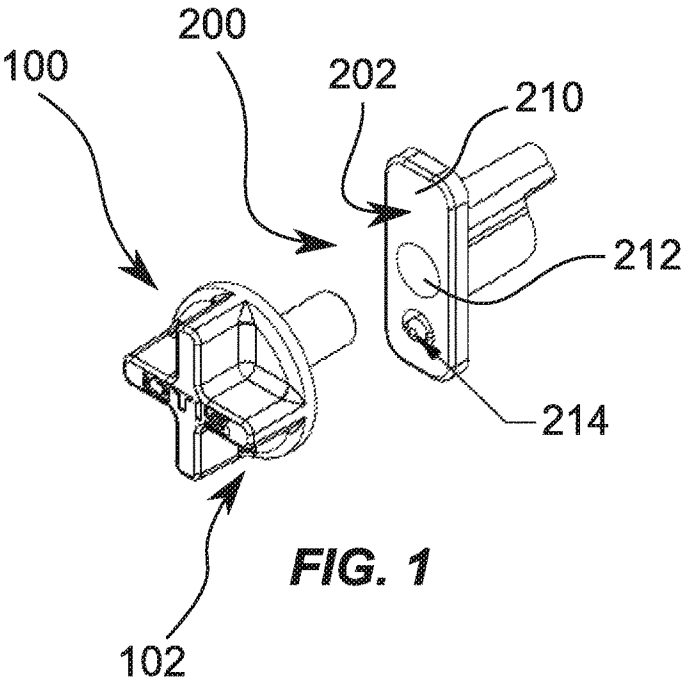
FIG. 1
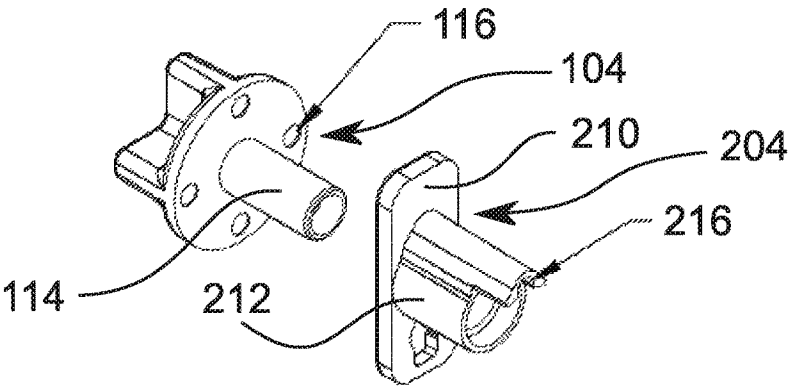
FIG. 2
FIG. 3
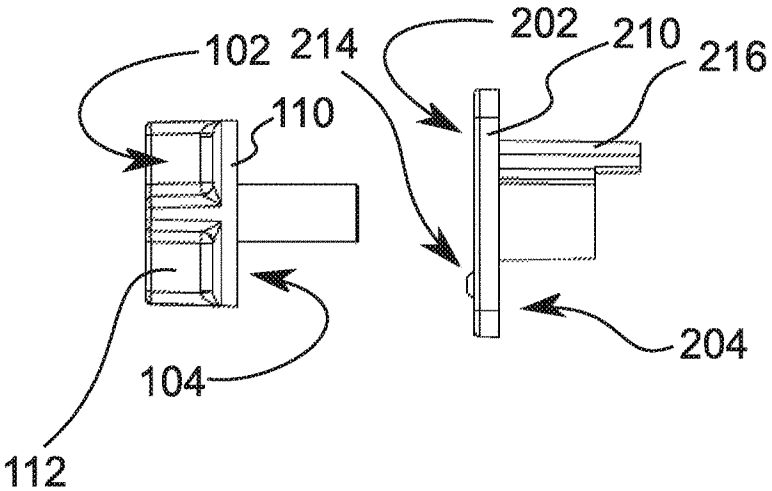
FIG. 4

FIREARM SIGHT ADJUSTMENT TOOL

CROSS REFERENCE TO RELATED APPLICATIONS

This application claims priority to U.S. Provisional Patent Application No. 62/587,173 filed on Nov. 16, 2017, the entire contents of which are herein incorporated by reference.

FIELD OF THE DISCLOSURE

This disclosure relates generally to tools for adjusting the sight of a firearm, such as a rifle.

BACKGROUND

Firearms frequently include a sight designed to assist the user in the accurate aiming of the firearm. One type of sight is a so called "iron sight" which may be provided on the top of the firearm and may include a pair of vertically extending guides or pillars. A user would utilize the sight by aligning the sightline of a downfield target between the vertically extending guides. A properly calibrated, or zeroed, sight would allow the user to accurately hit a down field target when aligned within the sight. Zeroing, or adjusting, the sight allows the user to change the orientation of the sight to ensure accurate aiming of the firearm.

FIG. 13 illustrates a common sight adjustment mechanism included in some firearms, such as an AR-15 rifle. The sight adjustment mechanism 10 may include a detent or pin 20 and a rotating wheel 30 having a plurality of circumferential grooves 32 as well as a vertical protrusion 34. Rotation of wheel 30 results in adjustment of the sight. Pin 20 may be compressible between a deployed position and a compressed position, with the deployed position serving as the default or at rest position of pin 20. Grooves 32 may have a corresponding dimension with pin 20 such that pin 20 in the deployed position fits within one of the grooves 32 thereby preventing the rotation of wheel 30. In order to adjust the sight, pin 20 would need to be compressed so as to permit free rotation of wheel 30. Without an adjustment tool, the combination of compressing pin 20 and rotating wheel 30 can be difficult. Moreover, while grooves 32 may be evenly disbursed along the circumferential edge of wheel 30, for instance at 90 degree intervals, the user may easily and unintentionally over rotate wheel 30 while pin 20 is compressed. In some instances, sight adjustment mechanism 10 may sit within a channel 40 defined by channel edges 42 on either side of sight adjustment mechanism 10.

SUMMARY OF THE DISCLOSURE

In one embodiment of the disclosure, a sight adjustment tool may be useable with a sight adjustment mechanism provided as part of a firearm. The sight adjustment mechanism may include a pin compressible between a deployed position and a compressed position as well as a rotatable wheel, and the wheel may include a protrusion projecting away from the wheel. The wheel may be rotatable with the pin in the compressed position and the wheel may be fixed with the pin in the deployed position. The sight adjustment tool may include a first component and a second component. The first component may include a first base having a first top side and a first bottom side, a grip provided on the top side of the base, and a shaft projecting from the bottom side of the base. The second component may include a second base having a second top side and a second bottom side, a tunnel dimensioned to receive the shaft, and a pin press protruding from the second bottom side of second base. The shaft may be rotatable within the tunnel when inserted into the tunnel, and the shaft may be operable to apply torque to the protrusion as the pin press compresses the pin.

In further embodiments of the disclosure, a firearm kit may include a firearm and a sight adjustment tool. The firearm may include a sight and a sight adjustment mechanism that includes a compressible pin, a rotatable wheel, and a protrusion projecting away from the wheel. The sight adjustment tool may be capable or interfacing with the firearm sight adjustment mechanism, and may include a first component and a second component. The first component may include a first base having a first top side and a first bottom side, a grip provided on the top side of the base, and a shaft projecting from the bottom side of the base. The second component may include a second base having a second top side and a second bottom side, a tunnel through dimensioned to receive the shaft, and pin press protruding from the second bottom side of second base. The shaft may be rotatable within the tunnel when inserted into the tunnel, and the shaft may be operable to apply torque to the protrusion as the pin press compresses the pin.

BRIEF DESCRIPTION OF THE FIGURES

FIG. 1 illustrates an exploded top-front perspective view of an embodiment of a sight adjustment tool.

FIG. 2 illustrates an exploded bottom-front perspective view of the sight adjustment tool of FIG. 1.

FIG. 3 illustrates a top view of the sight adjustment tool of FIG. 1.

FIG. 4 illustrates a side exploded view of the sight adjustment tool of FIG. 1.

DETAILED DESCRIPTION

Figure 6:
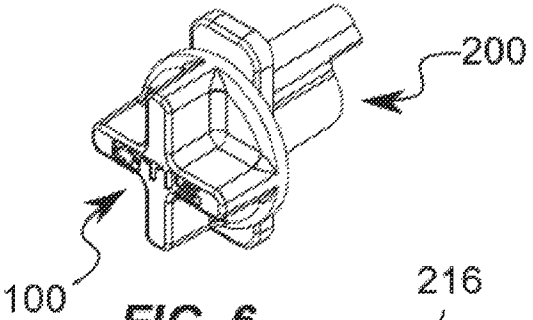
FIG. 6 illustrates a top-front perspective view of the sight adjustment tool of FIG. 1.
Figure 5:
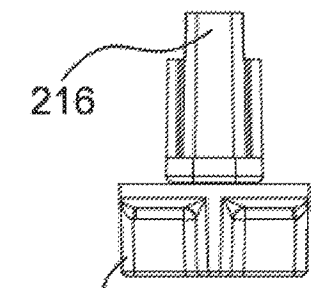
FIG. 5 illustrates a front view of the sight adjustment tool of FIG. 1.
Figure 7:
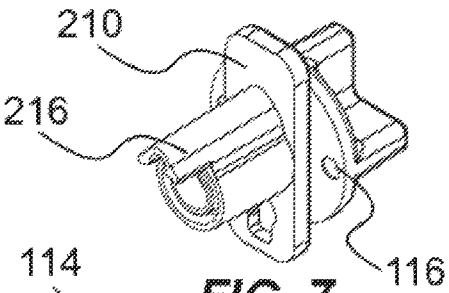
FIG. 7 illustrates a bottom-front perspective view of the sight adjustment tool of FIG. 1.
Figure 9:
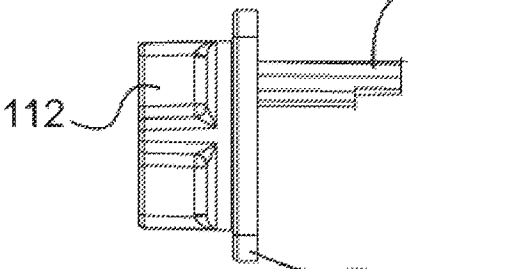
FIG. 9 illustrates a side view of the sight adjustment tool of FIG. 1.
Figure 8:
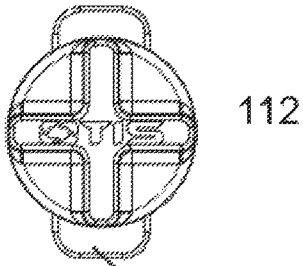
FIG. 8 illustrates a top view of the sight adjustment tool of FIG. 1.

The following detailed description and the appended drawings describe and illustrate some embodiments of the disclosure for the purpose of enabling one of ordinary skill in the relevant art to make and use these embodiments. As such, the detailed description and illustration of these embodiments are purely illustrative in nature and are in no way intended to limit the scope of the disclosure in any manner. It should also be understood that the drawings are not necessarily to scale and in certain instances details may have been omitted, which are not necessary for an understanding of the embodiments, such as details of fabrication and assembly. In the accompanying drawings, like numerals represent like components.

In one embodiment of the disclosure, a sight adjustment tool may be useable with a sight adjustment mechanism provided as part of a firearm. The sight adjustment mechanism may include a pin compressible between a deployed position and a compressed position as well as a rotatable wheel, and the wheel may include a protrusion projecting away from the wheel. The wheel may be rotatable with the pin in the compressed position and the wheel may be fixed with the pin in the deployed position. The sight adjustment tool may include a first component and a second component. The first component may include a first base having a first top side and a first bottom side, a grip provided on the top side of the base, and a shaft projecting from the bottom side of the base. The second component may include a second base having a second top side and a second bottom side, a tunnel dimensioned to receive the shaft, and a pin press protruding from the second bottom side of second base. The shaft may be rotatable within the tunnel when inserted into the tunnel, and the shaft may be operable to apply torque to the protrusion as the pin press compresses the pin.

The sight adjustment tool may further include a plurality of indents provided on the first bottom side of the first base, each of the plurality indents evenly spaced from one another at an interval distance, and a bulb provided on the second base and projecting towards the top side, the bulb dimensioned to be insertable within each of the indents. The wheel of the sight adjustment mechanism includes a plurality of grooves dimensioned to engage the pin in the deployed position, and the plurality of indents may include the same number of indents as there are grooves. The sight adjustment tool may include a plurality of bulbs provided on the first bottom side of the first base, each of the plurality of indents evenly spaced form one another at an interval distance, and an indent provided on the top side of the second base, the indent dimensioned to receive one of the plurality of bulbs.

In further embodiments of the disclosure, a firearm kit may include a firearm and a sight adjustment tool. The firearm may include a sight and a sight adjustment mechanism that includes a compressible pin, a rotatable wheel, and a protrusion projecting away from the wheel. The sight adjustment tool may be capable or interfacing with the firearm sight adjustment mechanism, and may include a first component and a second component. The first component may include a first base having a first top side and a first bottom side, a grip provided on the top side of the base, and a shaft projecting from the bottom side of the base. The second component may include a second base having a second top side and a second bottom side, a tunnel through dimensioned to receive the shaft, and pin press protruding from the second bottom side of second base. The shaft may be rotatable within the tunnel when inserted into the tunnel, and the shaft may be operable to apply torque to the protrusion as the pin press compresses the pin.

With reference to FIGS. 1-12, a sight adjustment tool may be composed of a first component 100 and a second component 200. First component 100 may be separable from second component 200 and rotatable with respect to second component 200. First component may include a grip 112, which in the illustrated embodiment is shaped as a cross-shaped knob, provided on the top side 102 of a base 110. Provided on a bottom side 104 of base 112 may be a shaft 114 insertable within a tunnel 212 of second component 200. Tunnel 212 may extend through the base 210 of second component towards In this regard, the outer surface of shaft 114 and the inner surface of aperture 212 may have complimentary dimensions and shapes, which in the illustrated embodiment is cylindrical, in order to permit free and smooth rotation of shaft 114 within tunnel 212. A bearing may also be utilized to facilitate free rotation of shaft 114 within tunnel 212. First component 100 and second component 200 may be manufactured as separate, detachable components or integral, inseparable components. The components may also be manufactured from any suitable material such as plastic or metal.

A plurality of grooves or indents 116 may be provided on bottom side 104 of base 110. These indents 116 may have a complimentary dimension with a bulb 214 protruding from the top side 202 of the second component 200. Bulb 214 may engage and disengage with an indent 116 as the first component 100 is rotated. Indents 116 may be evenly spaced, for instance at 90 degree intervals with four indents 116 as shown in the illustrated embodiment. An alternative number of indents 116 having greater or narrower spacing are contemplated within the disclosure, for instance by providing eight indents 116 spaced at 45 degree intervals or two indents spaced at 180 degree intervals. When bulb 214 is engaged with indentation 116, a resistance may be provided to slightly resist further rotation of first component 110. This resistance may be relatively easy to overcome to permit further rotation, but enough for a user to appreciate that first component 100 had rotated a full interval. Moreover, the engagement and disengagement of bulb 214 and indent 116 may result in an audible snap or click, which may further facilitate the user's confirmation that first component 100 was rotated a full interval. In further embodiments, a plurality of bulbs 214 may be provided on first component 100 while an indent 116 may be provided on second component 200.

A pin press 216 may also project from bottom side 204 of base 210. Pin press 216 may project past tunnel 212 so as to contact pin 20 on a firearm, as described further herein. Pin press may be an integral extension off of tunnel 212. In the illustrated embodiment, pin press 216 has an arcuate cross-section with a base portion 218 in order to facilitate interaction of the base portion 218 with pin 20 as it sits in a cavity on the firearm. Alternative cross-sections are contemplated within the disclosure so as to facilitate the contact of pin press 216 with the pin 20 on the firearm.

Figure 10:
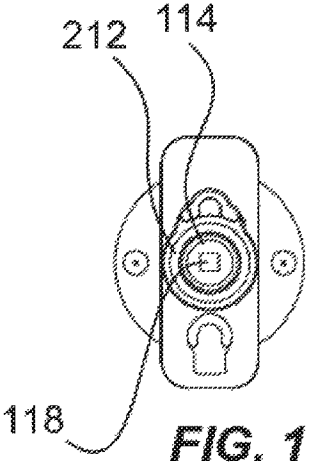
FIG. 10 illustrates a bottom view of the sight adjustment tool of FIG. 1.
Figure 11:
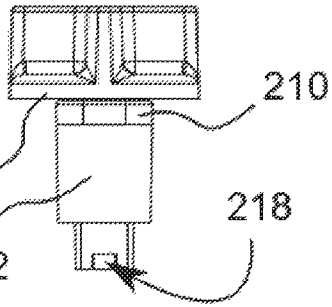
FIG. 11 illustrates a back view of the sight adjustment tool of FIG. 1.
Figure 12:
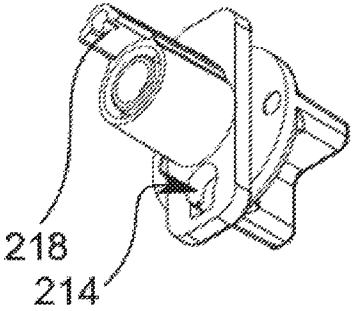
FIG. 12 illustrates a bottom-back perspective view of the sight adjustment tool of FIG. 1.

With particular reference to FIG. 10, an internal cavity 118 may be provided within shaft 114. The internal cavity 118 may have a square or slotted cross-sectional shape which is complimentary to a square or slotted cross-sectional shape of protrusion 34, described further herein. Internal cavity 118 may be affixed within, or integrally manufactured as part of, shaft 114 so as to permit rotational resistance on anything inserted within internal cavity 118. Indeed, as described further herein, internal cavity 118 may be slid over a protrusion 34, and rotation of component 100 may result in rotation of internal cavity 118 thereby applying rotational torque to protrusion 34 when inserted into internal cavity 118, which in turn rotates wheel 30 when pin 20 is compressed. To facilitate the transfer of applied torque, internal cavity 118 may have a conforming shape with protrusion 34. The illustrated embodiments show a complimentary square cross-sectional shape for both internal cavity 118 and protrusion 34, however further cross-sectional shapes are contemplated within the disclosure to accommodate application of torque on a protrusion 34 which does not have a square cross-sectional shape.

Figure 14:
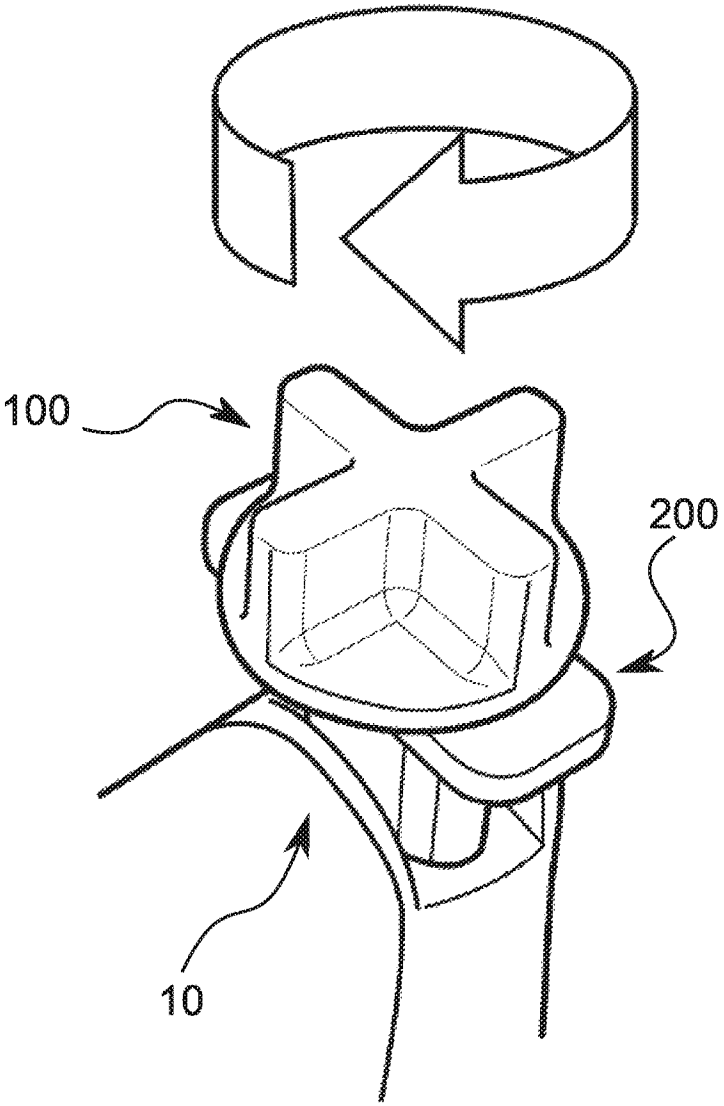
FIG. 14 illustrates a second step of utilizing an embodiment of a sight adjustment tool with an embodiment of a sight adjust on a firearm.
Figure 13:
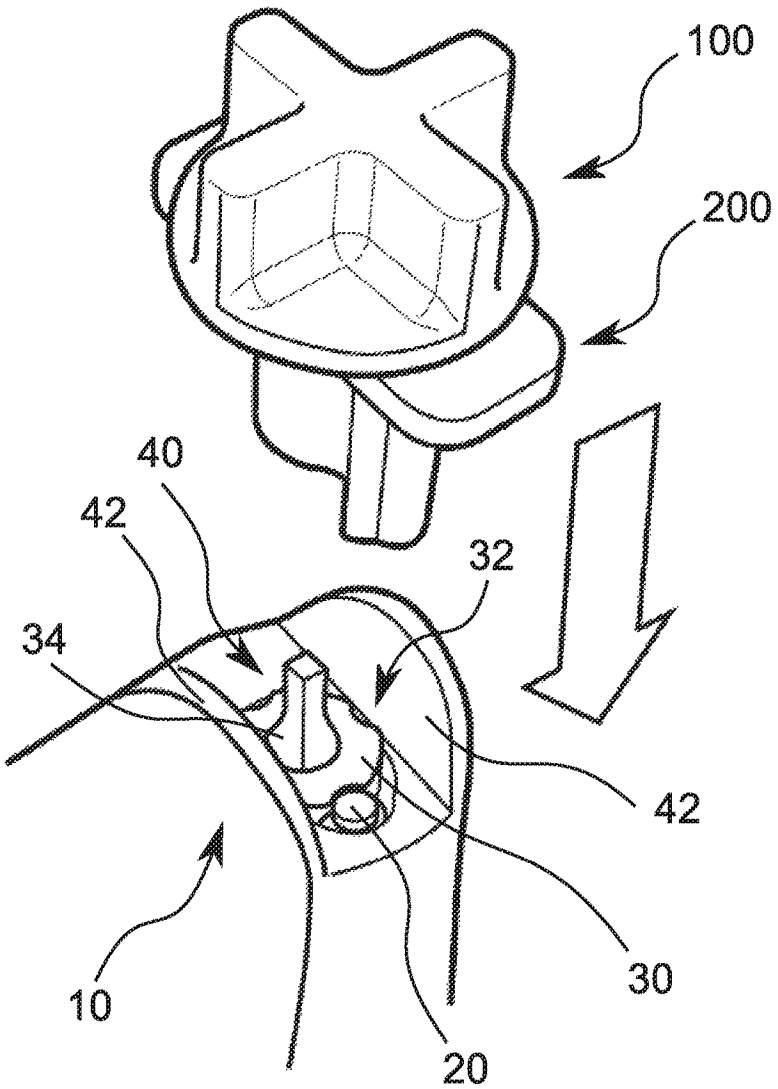
FIG. 13 illustrates a first step of utilizing an embodiment of a sight adjustment tool with an embodiment of a sight adjust on a firearm.

FIGS. 13 and 14 illustrate use of embodiments of a sight adjustment tool with a sight adjustment mechanism 10 provided on a firearm. With the first and second components 100, 200 adjoined, the sight adjustment tool may be aligned over adjustment mechanism 10 so that protrusion 34 enter into internal cavity 118 of shaft 114, while pin press 216 compresses pin 20. With pin 20 compressed, rotation of first component 100, for instance by turning of handle 112, may result in applied torque from internal cavity 118 to protrusion 34. A clicking sound in addition to the application of a slight resistance to the application of torque may occur after the rotation of first component 100 between intervals of spaced indentations 116. For example, in embodiments with four 90 degree spaced indentations, the user may be able to easily determine when protrusion 34 has been rotated 90 degrees. Moreover, the number of indentations 116 may coincide with the number of grooves 32, so that decompression of pin 20 may occur upon removal of the sight adjustment tool after one or more turns of a given number of intervals of the first component 100. Tunnel 212 may be dimensioned such that a bottom surface of tunnel 212 may contact the base surface of channel 40 adjacent to wheel 30. The base 210 of second component 200 may have a conforming or complimentary shape and dimension as with channel 40 so that channel edges 42 do not interfere with the use of the sight adjustment tool. In the illustrated embodiment, base 210 has a rectangular cross-section so as to avoid interference with channel edges 42.

Example dimensions, in inches, are provided in the figures. It should be understood that these dimensions are an example of dimensions which may be used with one embodiment of a sight adjustment mechanism 10 as shown and described herein. A person of ordinary skill in the art would appreciate these dimensions may be adjusted depending on the sight adjustment mechanism 10 which the sight adjustment tool is meant to be used with.

The descriptions set forth above are meant to be illustrative and not limiting. Various modifications of the embodiments, in addition to those described herein, will be apparent to those skilled in the art from the foregoing description. Such modifications are also intended to fall within the scope of the concepts described herein. Each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the embodiments in many other ways, using equivalents and alternatives that do not depart from the scope of the disclosure. Moreover, unless indicated to the contrary in the preceding description, none of the components described in the implementations are essential to the embodiments disclosed. It is thus intended that the embodiments be considered as illustrative, with a true scope and spirit of the disclosure being indicated by the following claims.

What is claimed:

1. A sight adjustment tool comprising:

a first component including a first base having a first top side and a first bottom side, a grip provided on the top side of the base, and a shaft projecting from the bottom side of the base; and a second component including a second base having a second top side and a second bottom side, a tunnel through the second component and dimensioned to receive the shaft, and a pin press protruding from the second bottom side of second base, wherein the shaft is rotatable within the tunnel when inserted into the tunnel, and the shaft is configured to apply torque to a protrusion projecting away from a rotatable wheel of a firearm sight adjustment mechanism as the pin press compresses a compressible pin of the firearm sight adjustment mechanism.

2. The sight adjustment tool of claim 1 further comprising:

a plurality of indents provided on the first bottom side of the first base, each of the plurality indents evenly spaced from one another at an interval distance; and a bulb provided on the second base and projecting towards the top side, the bulb dimensioned to be insertable within each of the indents.

3. The sight adjustment tool of claim 2, wherein the wheel of the sight adjustment mechanism includes a plurality of grooves dimensioned to engage the pin in a deployed position, and the plurality of indents includes the same number of indents as there are grooves.

4. The sight adjustment tool of claim 1 further comprising:

a plurality of bulbs provided on the first bottom side of the first base, each of the plurality of indents evenly spaced form one another at an interval distance; and an indent provided on the top side of the second base, the indent dimensioned to receive one of the plurality of bulbs.

5. The firearm kit of claim 1 wherein the sight adjustment tool includes:

a plurality of bulbs provided on the first bottom side of the first base, each of the plurality of indents evenly spaced form one another at an interval distance; and an indent provided on the top side of the second base, the indent dimensioned to receive one of the plurality of bulbs.

6. A firearm kit comprising:

a firearm including a sight and a sight adjustment mechanism that includes a compressible pin, a rotatable wheel, and a protrusion projecting away from the wheel; and a sight adjustment tool capable of interfacing with the firearm sight adjustment mechanism, the sight adjustment tool including a first component including a first base having a first top side and a first bottom side, a grip provided on the top side of the base, and a shaft projecting from the bottom side of the base, and a second component including a second base having a second top side and a second bottom side, a tunnel through the second component and dimensioned to receive the shaft, and a pin press protruding from the second bottom side of second base, wherein the shaft is rotatable within the tunnel when inserted into the tunnel, and the shaft is operable to apply torque to the protrusion as the pin press compresses the pin.

7. The firearm kit of claim 6 wherein the sight adjustment tool includes:

a plurality of indents provided on the first bottom side of the first base, each of the plurality indents evenly spaced from one another at an interval distance; and a bulb provided on the second base and projecting towards the top side, the bulb dimensioned to be insertable within each of the indents.

8. The firearm kit of claim 7 wherein the wheel of the sight adjustment mechanism includes a plurality of grooves dimensioned to engage the pin in a deployed position, and the plurality of indents includes the same number of indents as there are grooves.

* * * * *